US005829500A

United States Patent [19]

Van Elten

[11] Patent Number: 5,829,500

[45] Date of Patent: Nov. 3, 1998

[54] APPARATUS FOR PRODUCING SIDEWAYS CURVED WOODWOOL FIBRES

[75] Inventor: Gerrit Jan Van Elten, Voorthuizen, Netherlands

[73] Assignee: Bau-und Forschungsgellschaft Thermoform AG, Murten-Fribourg, Switzerland

[21] Appl. No.: 765,056

[22] PCT Filed: Jun. 13, 1995

[86] PCT No.: PCT/EP95/02279

§ 371 Date: Feb. 18, 1997

§ 102(e) Date: Feb. 18, 1997

[87] PCT Pub. No.: WO95/34415

PCT Pub. Date: Dec. 21, 1995

[30] Foreign Application Priority Data

Jun. 14, 1994 [NL] Netherlands ..... 9400960

[51] Int. Cl.[6] ..... B27C 1/12

[52] U.S. Cl. ..... 144/185; 144/42; 144/186; 144/176; 144/248.6; 144/373

[58] Field of Search ..... 144/3.1, 42, 162.1, 144/176, 185, 186, 242.1, 246.1, 248.6, 363, 373

[56] References Cited

U.S. PATENT DOCUMENTS

| | | | |
|---|---|---|---|
| 2,130,457 | 9/1938 | Fickett et al. . | |
| 3,000,412 | 9/1961 | Jaschke | 144/185 |
| 3,517,713 | 6/1970 | Filippo et al. . | |
| 4,148,345 | 4/1979 | Rogers | 144/185 |

FOREIGN PATENT DOCUMENTS

| | | | |
|---|---|---|---|
| A 1 022 118 | 2/1953 | France . | |
| 1009794 | 6/1957 | Germany | 144/186 |
| 1156549 | 10/1963 | Germany | 144/186 |
| 1 204 806 | 11/1965 | Germany . | |
| C 20 140 | 11/1982 | Germany . | |

*Primary Examiner*—W. Donald Bray
*Attorney, Agent, or Firm*—Darby & Darby

[57] ABSTRACT

The invention relates to an apparatus for producing sideways curved wood wool fibers. The apparatus comprises a flat rotatable disc (2), in the surface of which is provided at least one knife assembly (7) comprising a thickness knife (8) which projects slightly above the surface of the disc (2) and which has a cutting edge extending substantially radially and further comprising width knives (9) positioned as seen in the direction of rotation of said disc (2), ahead of said thickness knife (8) and having a cutting edge extending substantially tangentially. The width knives (9) are positioned in the immediate vicinity of the thickness knife (8), whereas their cutting edge may engage the thickness knife (8). Further the apparatus is provided with at least one feeding device (5) for feeding the disc (2) with wood blocks (6) to be cut up into fibers. Further a run-up guide may be positioned ahead of the width knives.

21 Claims, 2 Drawing Sheets

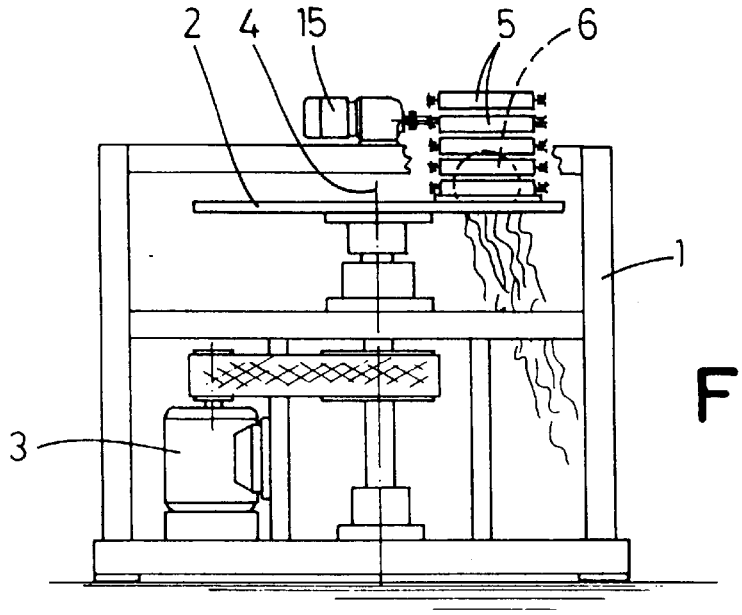
FIG. 1
FIG. 2
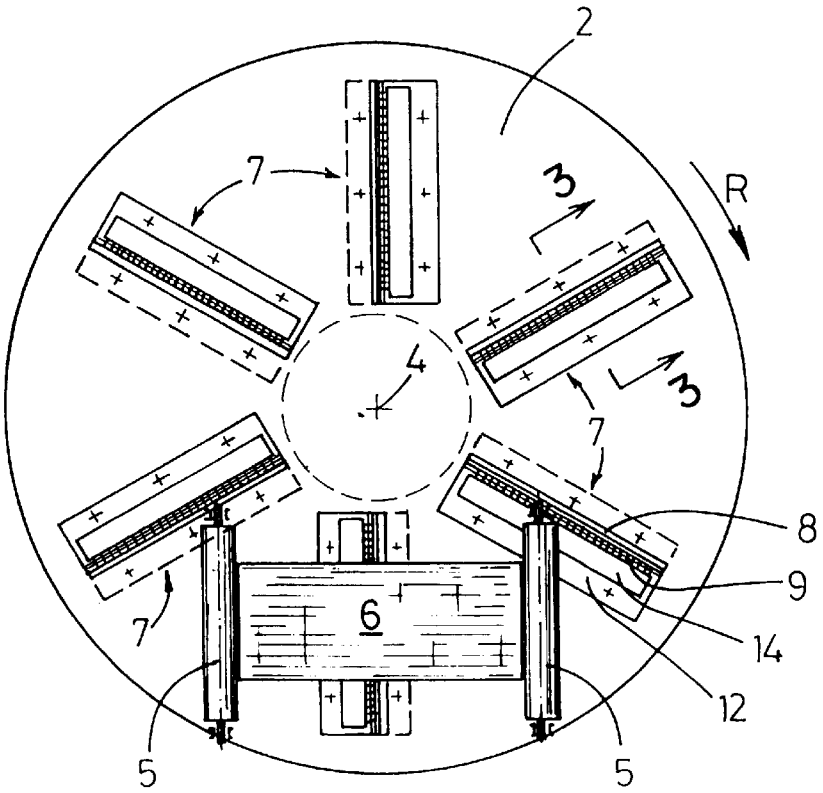

APPARATUS FOR PRODUCING SIDEWAYS CURVED WOODWOOL FIBRES

The invention relates to an apparatus for producing sideways curved woodwool fibres, with a flat rotatable disc, in the surface of which is provided at least one knife assembly comprising a thickness knife which projects slightly above the surface of the disc and which has a cutting edge extending substantially radially and further comprising width knives positioned, as seen in the direction of rotation of said disc, ahead of said thickness knife and having a cutting edge extending substantially tangentially, whereas the apparatus further comprises at least one feeding device for feeding the disc with wood blocks to be cut up into fibres.

Nowadays straight woodwool fibres are produced on a large scale. Woodwool comprising straight fibres is extremely fit for the production of woodwool cement boards for constructive purposes, such as self-supporting insulating roof boards. Because the fibres are cut along the full length, optimally in parallel with the grain of the wood, these fibres and woodwool cement boards made thereof maximally withstand tensile and compressive forces.

In practice straight woodwool fibres are almost exclusively planed using planing machines having a reciprocating carriage, in which knives are mounted and which is driven by a crank mechanism. One major disadvantage of these known machines is that generally these operate with only one cutting knife for each wood feeding location and, due to the large mass of carriage and crank mechanism to be reciprocated, can only make a limited amount of movements each minute, thus having a negative impact on the cutting speed and therefore the production capacity. Further, due to the low cutting speed and inevitable play between the carriage and the carriage guiding, the thickness of the produced fibres is irregular, whereas the surfaces of the fibres are not smooth, especially when the width of the fibres is determined by scraping, ploughing or carving rather than by cutting.

An example of such a planing machine having a reciprocating carriage is described in U.S. Pat. No. 2,605,793.

Further apparatuses are known (among others German patent 1,921,867) having cutting knives mounted in a rotating disc, with which straight woodwool fibres can be produced with large capacity.

However, applications exist at which straight woodwool fibres are less appropriate, for example when manufacturing acoustic ceiling panels to be mounted visibly. Now almost no demands exist in respect of the bending and tensile strength of the boards, however from an acoustic point of view an open structure, and from an aesthetic point of view a curved surface structure are preferred. From an aesthetic point of view all fibres should disengage each other entirely and should individually have a regular thickness and width. Further the fibres should be free of hairs and frills, meaning that the thickness and width of the individual fibres has to be determined with high speed by sharp knives rather than by other means employing carving, scraping, ploughing or ripping. It is to be understood, that disengaging frills may form lumps together with cement powder which is used in the boards, said lumps having a negative influence on the acoustic and aesthetical performance of the boards. Further all fibres should have a uniform thickness and width, wherein it is essentially that the thickness of the fibres, often only being 0,2 until 0,4 mm, is cut precisely in parallel to the grain of the wood.

In the light of the above one has tried already in the past to produce sideways curved woodwool fibres. The advantage of such sideways curved woodwool fibres is that they allow the manufacture of aesthetically appealing ceiling panels and the like having an open and curved structure. The curved shape of the fibres almost fully excludes that in the plates fibres are positioned on line alongside and on top of each other, as may happen with straight fibres. As a result panels produced of such sideways curved woodwool fibres obtain an aesthetically appealing uniform curved open structure providing a high acoustical sound absorption.

Attempts to produce such sideways curved woodwool fibres have resulted into several known apparatusus. One such apparatus, describing the state of the art according to the preamble of the main claim, shows U.S. Pat. No. 2,712,842. Using this apparatus it is possible to produce sideways curved woodwool fibres, however it is a disadvantage of this apparatus that woodwool fibres produced therewith do not fully comply with the quality requirements. In this known apparatus the distance between the width knives and the thickness knife is so large, that vibrations in the wood blocks to be cut up into fibres will lead to irregular cuts, on one hand leading to a lot of wood dust and on the other hand resulting in the fact that often the woodwool fibres are not fully cut loose from each other. Further the width of the woodwool is not determined by cutting, but by carving or ploughing, this leading to irregular surfaces at the edges of the woodwool and to an unwanted production of wood dust. Further no measures are taken to guarantee a fully regular thickness of the woodwool fibre.

Another example of a known apparatus for producing sideways curved woodwool fibres is described in U.S. Pat. No. 2,130,457. In this apparatus assemblies comprising a combe knife and a following flat planing knife are applied in a flat rotatable disc. The surface of the wood blocks to be cut up into fibres is firstly cut into fibres by teeth of the combe knife, whereafter the remaining ripples are planed down by the flat planing knife. Among others it is a disadvantage of this apparatus that by planing using knives, of which the cutting edges are interrupted by grooves, there are produced frills and irregular surfaces at the edges of the woodwool fibres. Further in this known apparatus the feeding of wood blocks is such that the cutting of the very small thickness does not occur in parallel to the grain of the wood, such that during planing and the following production process for obtaining end products (such as ceiling panels) fibres may frequently break, producing a lot of waste material and diminishing the aesthetical value. As a result this known apparatus is mostly appropriate for producing saw-dust and less for producing wood shavings and woodwool, being subject to special demands in relation to the tensile and bending strength.

Thus it is an object of the invention to provide an apparatus for producing sideways curved woodwool fibres of the type referred to above, using which the mentioned disadvantages can be eliminated in a simple, but nevertheless effective way.

For this the apparatus according to the invention is characterised in that the width knives are positioned in the immediate vicinity of the thickness knife.

With the apparatus according to the invention sideways curved woodwool fibres can be produced complying with the most stringent quality requirements. Instead of by carving, ploughing or ripping, the production of the woodwool fibres occurs entirely on the basis of cutting, i.e. cutting the width of the woodwool fibres by the width knives and cutting the thickness by the following thickness knife. If the wood blocks are fed having their longidutinal axis in parallel with the plane of the rotatable disc the width knives and the thickness knife carry out rotating movements in a plane in which the grains of the wood are positioned, such that strong woodwool fibres are produced and the wood block can fully be planed down.

The sideways curved woodwool fibres produced using the width knives and thickness knife have at all sides smooth surfaces, such that almost no wood dust is produced and the woodwool fibres are free from frills. Because the width knives are positioned in the immediate vicinity of the thickness knives the influence of vibrations of the wood blocks to be cut up into fibres and vibrations of parts of the apparatus on the cutting depth of the width knives and the relative position between the cut made by the width knives and the cut made by the thickness knife are substantially eliminated, such that uniform woodwool fibres, entirely cut loose from each other, can be manufactured.

In correspondence with a preferred embodiment of the apparatus according to the invention the width knives engage the thickness knife with their cutting edge. In practice it appeared, that with such an embodiment an optimised result may be obtained.

Further it is preferred that, as seen in the direction of rotation of said disc, ahead of said width knives a run-on guide is provided for positioning a wood block to be cut up into fibres relative to the knives. This, preferably wear-resistant, run on-guide takes care of a regular thickness of the obtained woodwool fibres, which is mostly independent from the cutting force and the force with which the wood blocks to be cut up into fibres are pressed against the disc.

If, in accordance with a handy embodiment of the apparatus according to the invention, the run-up guide comprises a number of run-up ribs spaced apart in the radial direction of the disc and extending tangentially, the desired guiding of the wood blocks to be cut up into fibres is combined with a low friction, as a result of which the required power for driving the apparatus may be minimized.

It is conceivable too, that the run-up guide forms part of the width knives, such that an improved heat removal occurs and the risk of breaking of the width knives is reduced.

For improving the capacity of the apparatus it is possible, that the disc is provided with a number of, preferably equi-angular distanced, knife assemblies.

In respect of mounting and substituting the knives it may be handy, that the thickness knife and/or the width knives are housed in knife casings which are positionable into corresponding recesses of the disc. Grinding and setting operations and alike can be carried out quickly then, without necessitating complicated assembling and disassembling operations.

Hereinafter the invention will be elucidated referring to the drawing, in which an embodiment of the apparatus according the invention is illustrated.

FIG. 1 shows a side elevational view of an apparatus according to the invention for producing sideways curved woodwool fibres;

FIG. 2 shows a top plan view of the rotatable disc applied in the apparatus according to FIG. 1.

Figure 3:
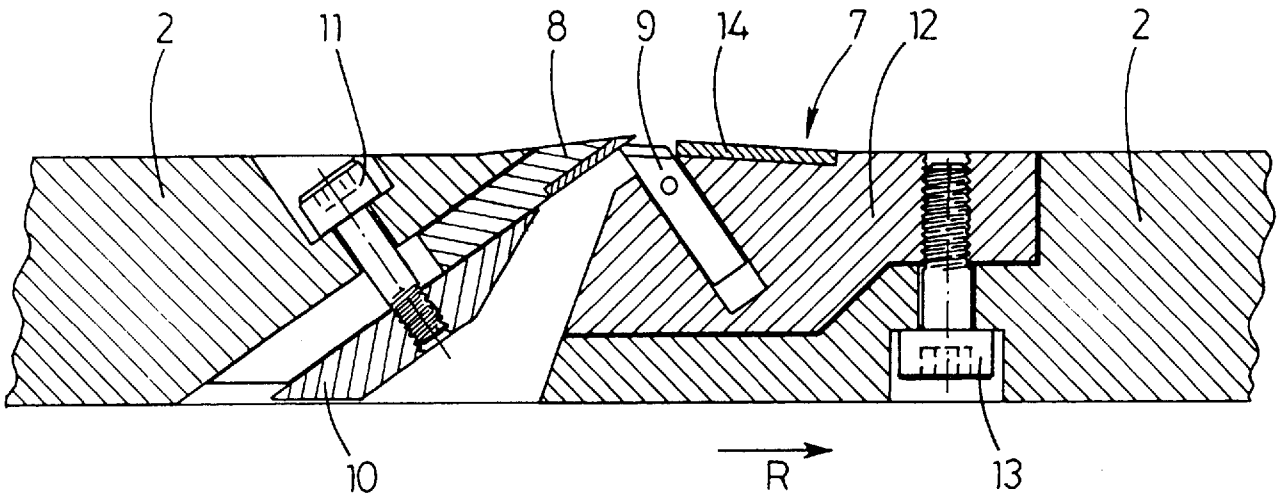
FIG. 3 shows on a larger scale a section according to 3—3 in FIG. 2.

The apparatus illustrated in FIG. 1 has a frame 1 in which a flat disc 2 is journalled in a horizontal position and can be driven by a motor 3. As a result the disc 2 can rotate about a vertical axis 4. The motor 3 drives the disc 2 with a high RPM-number.

Above the disc 2 at least two feeding rollers 5 are provided which are positioned in pairs at some distance from each other (see also FIG. 2). These feeding rollers may receive between themselves wood blocks 6 to be cut up into fibres, in such a way that the axis of the wood blocks (and thus the direction of the grain of the wood) extends substantially in parallel to the plane of the disc 2. The feed rollers 5 are driven by a motor 15, such that the wood block 6 is moved towards the surface of the rotatable disc 2. Further a non-illustrated pusher may engage the upper side of the wood block 6, pressing the wood block 6 without any remainder against the disc and during planing damping the remaining piece against vibrations. This may be realised too using a directly following successive block of wood.

In the region of the lowermost feeding rollers 5 auxiliary guidings may be applied at a short distance above the disc 2, which have to avoid that a remaining piece of the wood block to be cut up into fibres gets stuck between a lowermost feeding roller 5 and the disc 2.

It is possible that the feeding roller pairs engaging opposite frontal ends of a wood block to be cut up into fibres are movable relative to each other so as to adapt to wood blocks having different lengths. It is noted however, that instead of feeding rollers 5 also other means can be applied for feeding the wood blocks to the disc 2.

The disc 2 represented on a larger scale in FIG. 2 comprises a number of knife assemblies 7. These knife assemblies 7 are, equi-angular distanced from each other, regularly distributed over the surface of the disc 2. Although in FIG. 2 six of these knife assemblies 7 have been shown, this number may be increased or diminished.

Referring to FIG. 3 it appears that each knife assembly 7 mainly comprises a thickness knife 8 and width knives 9, positioned, as seen in the direction of rotation of the disc (indicated by arrow R in FIG. 2 and FIG. 3) ahead of the thickness knife 8.

The thickness knife 8 extends slightly above the surface of the disc 2 and comprises a cutting edge extending substantially radially relative to the disc 2 (this is clearly visibly in FIG. 2). Using a clamping plate 10 and tensioning bolts 11 the thickness knife 8 is attached to the disc 2. Of course other ways of mounting are conceivable.

Each knife assembly 7 is provided with a large number of width knives 9 which are spaced apart in the radial direction of the disc 2 and of which the cutting edge extends substantially in the tangential direction of the disc. The mutual distance between the width knives 9 determines the width of the produced woodwool fibres, whereas especially the number of knife assemblies, the rotational velocity of the disc and the feeding velocity of the wood determine the thickness of the produced woodwool fibres.

The width knives 9 can be mounted in a mounting block, possibly beforehand, said mounting block 12 being attached to the disc 2 using tensioning bolts 13 too. Also in this case other mounting ways are possible.

It is conceivable too, that the thickness knife 8 and the width knives 9 are being mounted in so-called knife-casings, which are housed in corresponding recesses in the disc 2. In such a case a combined knife-casing may be applied for the thickness knife and the width knives. Of course it is possible too to replace complete discs with knife assemblies provided integrally therein.

As appears clearly from FIG. 3 the width knives 9 are positioned in the immediate vicinity of the thickness knife 8, such that in the embodiment illustrated the cutting edge of the width knives 9 even engages the thickness knife 8. This latter measure however is not necessary for a good operation of the apparatus. However, if the width knives do not engage the thickness knife 8 the cutting edges of the width knives 9 will have to extend above the surface of the disc 2 at least as far as the cutting edge of the thickness knife 8.

Immediately ahead of the width knives 9, as seen in the direction of rotation of the disc 2, a run-up guide 14 is provided extending somewhat above the surface of the disc 2. The slightly sloping plane of this run-up guide 14 results in the fact that a wood block to be cut up into fibres is guided such in respect of its height position at the location of the width knives 9 and the thickness knife 8 that on one hand the width knives 9 make a constant deep cut into the wood block and that on the other hand the thickness knife 8 slices off fibres having a constant thickness. Moreover in this way firstly the production of wood dust is prevented whereas secondly it is guaranteed that the width knives fully cut loose from each other all fibres. This run-up guide can (in a way not shown further) comprise a number of run-up ribs spaced apart in the radial direction of the disc and extending tangentially.

When using the apparatus according to the invention the width knives 9 make cuts into the wood block along circular paths, in planes in parallel with the grain of the wood, wherein the mutual distance between the cuts corresponds with the width of the woodwool fibres to be produced. Next the thickness knife 8 cuts loose these curved fibres from the wood block. Depending upon the mutual position of the width knives 9 and the thickness knife 8 it is conceivable that firstly the cutting edge of the thickness knife 8 engages the wood block and that only thereafter or at the same time the cutting edges of the width knives start to function.

For completeness sake it is noted, that the apparatus according to the invention can be provided with a number of feeding devices, for example two, such that woodwool fibres can be produced simultaneously at a number of locations. As a result the capacity of the apparatus can be increased considerably.

The invention is not limited to the embodiment described before, which may be varied widely within the scope as defined by the claims.

I claim:

1. An apparatus for producing sideways curved woodwool fibres, having a flat rotatable disc, in the surface of which is provided at least one knife assembly comprising a thickness knife which projects slightly above the surface of the disc and which has a cutting edge extending substantially radially and further comprising width knives positioned, as seen in the direction of rotation of said disc, ahead of said thickness knife and having a cutting edge extending substantially tangentially relative to the disc, whereas the apparatus further comprises at least one feeding device for feeding the disc with wood blocks to be cut up into fibres, wherein the cutting edges of the width knives are positioned substantially adjacent to the cutting edge of the thickness knife.

2. The apparatus of claim 1 wherein the width knives engage the thickness knife with their cutting edge.

3. The apparatus of claim 1, further comprising:

a run-on guide, wherein as seen in the direction of rotation of said disc, ahead of said width knives, the run-on guide is provided for positioning a wood block relative to the knives to be cut up into fibres.

4. An apparatus for producing sideways curved woodwool fibres, comprising:

a flat rotatable disc;

at least one knife assembly provided in a surface of the disc and having:

a thickness knife which projects slightly above the surface of the disc, with the knife assembly having a cutting edge extending substantially radially; and width knives positioned, as seen in the direction of rotation of the disc, ahead of said thickness knife and having a cutting edge extending substantially tangentially relative to the disc, wherein the width knives are positioned substantially adjacent to the thickness knife;

a run-on guide having a plurality of run-up ribs spaced apart in the radial direction of the disc and extending tangentially and positioned, as seen in the direction of rotation of said disc, ahead of said width knives for positioning a wood block to be cut up into fibres; and at least one feeding device for feeding the disc with wood blocks relative to the width knives to be cut up into fibres.

5. The apparatus of claim 4, wherein the width knives engage the thickness knife with their cutting edge.

6. The apparatus of claim 4, wherein the disc is provided with a plurality of equi-angular distanced, knife assemblies.

7. The apparatus of claim 4, wherein the thickness knife and the width knives are housed in knife casings which are positionable into corresponding recesses of the disc.

8. The apparatus of claim 4, having a plurality of feeding devices.

9. An apparatus for producing sideways curved woodwool fibres, comprising:

a flat rotatable disc;

at least one knife assembly provided in a surface of the disc and having:

a thickness knife which projects slightly above the surface of the disc, with the knife assembly having a cutting edge extending substantially radially; and width knives positioned, as seen in the direction of rotation of the disc, ahead of said thickness knife and having a cutting edge extending substantially tangentially relative to the disc, wherein the width knives are positioned substantially adjacent to the thickness knife;

a run-on guide positioned, as seen in the direction of rotation of said disc, ahead of said width knives for positioning a wood block to be cut up into fibres, wherein the run-up guide forms part of the width knives; and at least one feeding device for feeding the disc with wood blocks relative to the width knives to be cut up into fibres.

10. The apparatus of claim 3, wherein the disc is provided with a plurality of equi-angular distanced, knife assemblies.

11. The apparatus of claim 3, wherein the thickness knife or the width knives are housed in knife casings which are positionable into corresponding recesses of the disc.

12. The apparatus of claim 11, wherein, for each respective knife casing, the thickness knife and width knives are housed in one and the same knife casing.

13. The apparatus of claim 1, wherein the width knives and thickness knives are integrally mounted in the disc to form a single replaceable combination with the disc.

14. The apparatus of claim 3, having a plurality of feeding devices.

15. A woodwool produced using the apparatus of claim 1.

16. A woodwool produced using the apparatus of claim 4.

17. The apparatus of claim 9, wherein the width knives engage the thickness knife with their cutting edge.

18. The apparatus of claim 9, wherein the disc is provided with a plurality of equi-angular distanced, knife assemblies.

19. The apparatus of claim 9, wherein the thickness knife and the width knives are housed in knife casings which are positionable into corresponding recesses of the disc.

20. The apparatus of claim 9, having a plurality of feeding devices.

21. A woodwool produced using the apparatus of claim 9.

* * * * *

UNITED STATES PATENT AND TRADEMARK OFFICE

CERTIFICATE OF CORRECTION

PATENT : 5,829,500

DATED : November 3, 1998

INVENTOR(S) : Gerrit Jan Van Elten

It is certified that error appears in the above-identified patent and that said Letters Patent is hereby corrected as shown below:

On the title page, item [73], should read --Bau-Und Forschungsgesellschaft Thermoform AG--.

On the title page, item [57], the "ABSTRACT" text, lines 1-16, should be deleted, and substitute therefor the text as shown on the attached page.

UNITED STATES PATENT AND TRADEMARK OFFICE

CERTIFICATE OF CORRECTION

PATENT : 5,829,500

DATED : November 3, 1998

INVENTOR(S) : Gerrit Jan Van Elten

It is certified that error appears in the above-identified patent and that said Letters Patent is hereby corrected as shown below:

--An apparatus has a flat rotatable disc in which at least one knife assembly is mounted to produce sideways curved woodwool fibres. Each knife assembly has a thickness knife which projects slightly above the surface of the disc and which has a cutting edge extending substantially radially. Each knife assembly also has width knifes positioned, as seen in the direction of rotation of the disc, ahead of the thickness knife. Each of the width knifes also has a cutting edge extending substantially tangentially relative to the disc. The cutting edges of the width knives are positioned substantially adjacent to the cutting edge of the thickness knife to engage the thickness knife. The apparatus also includes at least one feeding device for feeding the disc with wood blocks to be cut up into fibres. A run-up guide is also included which is positioned ahead of the width knives.--.

Signed and Sealed this

Thirteenth Day of April, 1999

*Attest:*

*Attesting Officer*

Q. TODD DICKINSON

*Acting Commissioner of Patents and Trademarks*